US005265688A

United States Patent [19]

Rumpp et al.

[11] Patent Number: 5,265,688

[45] Date of Patent: Nov. 30, 1993

[54] ROCK DRILL

[75] Inventors: Gerhard Rumpp, Inning-Ammersee; Josef Obermeier, Peiting; Josef Fuenfer, Königbrunn, all of Fed. Rep. of Germany

[73] Assignee: Hilti Aktiengesellschaft, Schaan, Liechtenstein

[21] Appl. No.: 951,294

[22] Filed: Aug. 17, 1992

Related U.S. Application Data

[63] Continuation of Ser. No. 681,788, Apr. 8, 1991, abandoned.

[30] Foreign Application Priority Data

Apr. 9, 1990 [DE] Fed. Rep. of Germany ..... 4011441

[51] Int. Cl.[5] ..... E21B 10/44

[52] U.S. Cl. ..... 175/394; 408/230

[58] Field of Search ..... 175/323, 349, 394; 408/230

[56] References Cited

U.S. PATENT DOCUMENTS

| | | | |
|---|---|---|---|
| 3,372,763 | 3/1968 | Fischer | 175/323 |
| 4,210,215 | 7/1980 | Peetz et al. | 175/323 |
| 4,393,947 | 7/1983 | Lutze et al. | 175/323 |
| 4,852,670 | 8/1989 | Peetz et al. | 175/323 |
| 4,883,135 | 11/1989 | Moser et al. | 175/394 |
| 4,889,200 | 12/1989 | Moser | 175/394 |
| 4,967,885 | 11/1990 | Moser | 175/394 |

*Primary Examiner*—Ramon S. Britts
*Assistant Examiner*—Frank S. Tsay
*Attorney, Agent, or Firm*—Anderson Kill Olick & Oshinsky

[57] ABSTRACT

A rock drill has an axially extending shank (1) with a drill head (2) on one end. The drill head (2) has an end face (3) with a cutting blade (4) and cutting pins (5) extending outwardly from the end face in the drilling direction. The cutting blade (4) extends diametrically across the end face and projects radially outwardly from the drill head (2) and axially outwardly from the end face (3). The cutting pins (5) are arranged on a diameter of the drill head which forms an acute angle relative to the cutting blade (4). Due to the acute angle between the cutting pins and the diametrically arranged cutting blade, removal grooves extending axially from the end face can be enlarged.

6 Claims, 1 Drawing Sheet

ROCK DRILL

This is a continuation of application Ser. No. 07/681,788, filed Apr. 8, 1991, now abandoned.

BACKGROUND OF THE INVENTION

The present invention is directed to a rock drill with a drill head at one end of an axially extending shank. A cutter blade extends diametrically across and projects radially outwardly from the drill head and at least two cutter pins extend outwardly from the drill head end face in the drilling direction.

Rock drills are used for cutting holes or bores in rock, concrete, masonry and the like and serve for receiving fastening members, as passages for pipes or cables as well as for explosives in blasting operations. Rock drills having a combination of cutting blades and cutting pins have the advantage that the drilled material or drillings removed by the cutting blade are further comminuted by the cutting pins. Such rock drills are disclosed in DE-OS 35 44 433. For a variety of working conditions, the output level of such known rock drills is satisfactory. Under certain operating conditions, however, the removal of the drillings and the feed of the rock drill is not optimum.

SUMMARY OF THE INVENTION

The primary object of the present invention is to provide a rock drill enabling additional comminution of the drillings at a high material drilling rate, while affording an improved removal of the drillings.

In accordance with the present invention, the improved operation is achieved by locating the cutting pins on a diameter of the drill head positioned at an acute angle with the diametrically extending cutting blade. Due to the arrangement of the cutting pins in accordance with the present invention, an enlargement of the drilled material removal grooves is obtained.

Advantageously, the cutting pins are located on both of the opposite sides of the cutting blade. Accordingly, a symmetrical arrangement is possible.

This feature is particularly applicable when the number of cutting pins is equal on both sides of the cutter blade. With an equal number of cutting pins on the opposite sides of the cutting blade, a more uniform communition of the drilled material is gained along with a smoother operation of the rock drill.

By locating two cutting pins in the radially outer edge zone of the drill head, an additional centering effect of the rock drill is obtained during the drilling operation.

Preferably, the cutting pins are arranged rotationally symmetrical to axis of the shank. Such an arrangement assures an improved operational smoothness of the rock drill along with a precise drilling geometry.

In a preferred arrangement, the acute angle between the diameter on which the cutting pins are located and the diametrically arranged cutter blade is in the range of 40° to 70°. Such an angular range has proved especially satisfactory, because the arrangement of sufficiently large removal grooves is particularly favorable in the end face of the drill head in the region of the complementary obtuse angle.

A helical rib adjoins the removal groove with the helical rib determining the direction of rotation of the rock drill. The acute angle formed by the diametrically arranged cutter blades and the diameter on which the cutting pins are located is preferably arranged on the side of the cutting blade trailing in the rotational direction.

It is especially effective for the comminution of the drilled material, to arrange the cutting pins inclined outwardly relative to the shank axis, however, the arrangement of the cutting pins parallel to the shank axis is also possible.

The leading end faces of the cutting pins pointing in the drilling direction preferably do not lie on the conical rotational plane formed by the cutting edges of the cutting blade, rather they are offset rearwardly from such plane, for example, in the range of 0.3 mm to 1.5 mm. Accordingly, the feed velocity during the drilling operation is more uniform, since the cutting pins contact the surface of the material being drilled at nearly the same point in time as the cutting blade.

As a result, a more uniform removal of the drilled material is attained. In addition, the cutting pins assume an abutment function for the drill head in the drilling direction.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
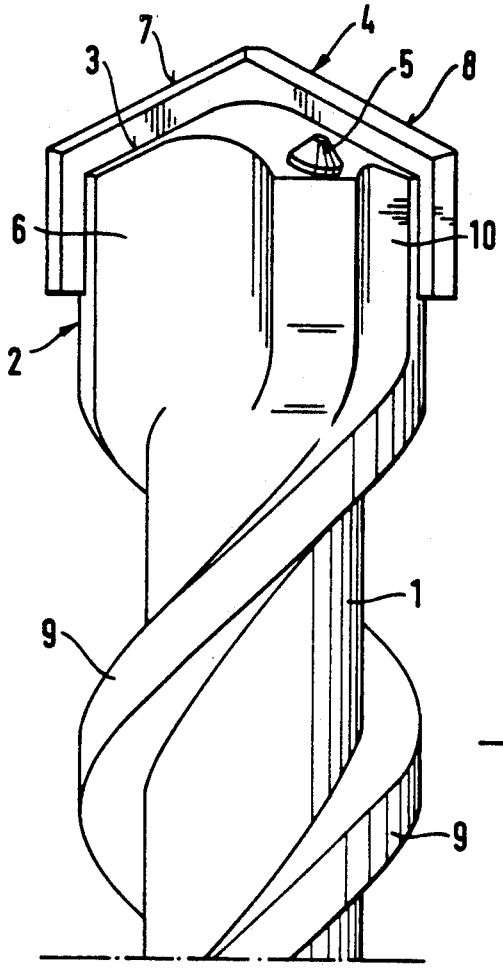
FIG. 1 is a partial axially extending view of a rock drill embodying the present invention.
Figure 3:
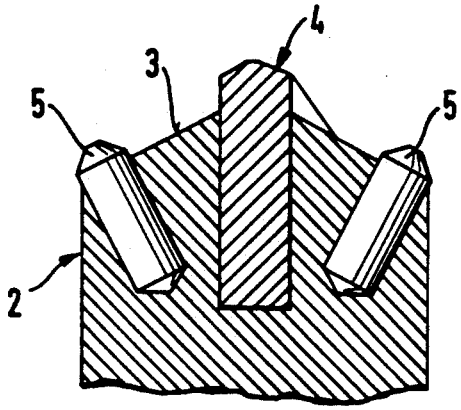
FIG. 3 is an axially extending sectional view through the rock drill in FIGS. 1 and 2, taken along the line III—III in FIG. 2.
Figure 2:
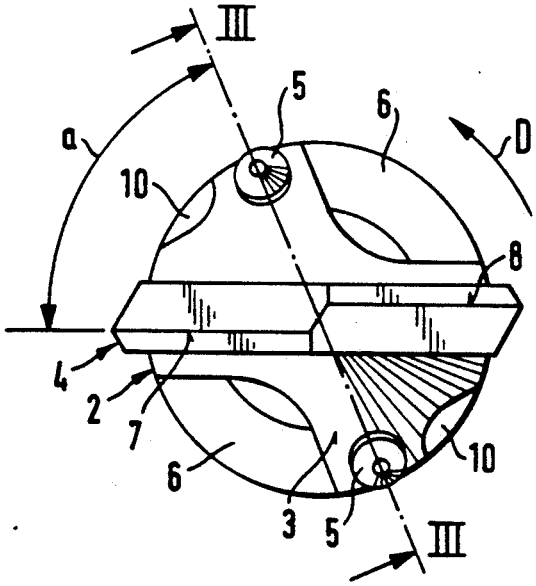
FIG. 2 is an end view of the rock drill as shown in FIG. 1.

In FIGS. 1, 2 and 3 a rock drill is shown comprising an axially extending shank 1 with a drill head 2 formed on one end of the shank. Shank 1 has a helical rib 9 projecting outwardly from its outer surface for guiding the drill in a hole being drilled and also for aiding in the removal of the drilled material or drillings. Drill head 2 has axially extending removal grooves 6, 10 extending from the end face 2 of the drill head and serving for conveying the drillings from the end face opposite to the drilling direction toward the shank 1. A diametrically positioned cutting blade 4 extends across the end face 3 of the drill head 2. Cutting blade 4 projects axially in the drilling direction from the end face of the drill head and also projects radially outwardly from the circumference of the drill head. A pair of cutting pins 5 are secured in the drill head and extend outwardly from the end face. The cutting pins 5 are located on a diameter of the drill head which encloses an acute angle a with the diametrically arranged cutting blade 4. Acute angle a, shown in FIG. 3, is formed with the side of the cutting blade trailing in the rotational direction D.

In the sectional view afforded in FIG. 3, it is shown clearly that the cutting pins 5 are inclined outwardly from the shank axis in the drilling direction. The cutting pins 5 are embedded into the drill head 2 so that the leading ends of the cutting pins 5 project outwardly from the end face 3 but are located between the end face and the conical plane formed by the inclined cutting edges 7, 8 of the cutting blade 4.

While the illustrated embodiment shows one pair of cutting pins 5, additional pairs can be provided. The arrangement of the cutting blade 4 and the cutting pins 5 is symmetrical in the rotational direction.

As displayed in FIG. 2, the rock drill rotates counter clockwise, note the rotational direction D, so that the cutting edge 7, as it moves in the rotational direction D, is followed by the removal groove 10, the cutting pin 5, the removal groove 6, and then the cutting edge 8 which, in turn, is followed by the removal groove 10, the cutting pin 5, and the removal groove 6.

As can be noted in FIG. 2, the angular extent of the removal grooves 6 is enlarged due to the angular position of the cutting pins 5 relative to the cutting blade 4.

While specific embodiments of the invention have been shown and described in detail to illustrate the application of the inventive principles, it will be understood that the invention may be embodied otherwise without departing from such principles.

We claim:

1. A rock drill having an axis extending in a drilling direction and having a rotational direction, said rock drill comprising an axially extending shank (1) and a drill head (2) having an outside diameter and located at and extending axially outwardly from a first end of said shank, said shank having an outside surface, said drill head axially aligned with said shank, said drill head having an end face (3) extending transversely of the drilling direction, a cutting blade mounted in said drill head and extending diametrically across said end face traversing the axis of said drill head and extending axially from and radially outwardly beyond the outside diameter of said drill head, and at least two cutting pins (5) mounted in and extending outwardly from the end face of said drill head, a helical rib (9) extending around and outwardly from the outside surface of said shank from the first end thereof away from said drill head (2), wherein the improvement comprises that said cutting pins (5) are each located on a single straight line extending through the axis of said drill head with the straight line spaced at an acute angle (a) from the cutting blade (4), said cutting pins (5) are located on the single straight line each on an opposite side of said cutting blade (4), and said cutting pins (5) are rotationally symmetrical relative to the shank axis and are located in a radially outer edge zone of said drill head, said drill head having axially extending removal grooves (6, 10) extending from the end face (3) of the drill head (2) to adjacent the first end of said shank for conveying drilled material for passage along said shank and helical ribs, said removal grooves comprising first removal grooves (6) having a larger angular extent than second removal grooves (10), and in the rotational direction of said rock drill the first removal grooves trail said cutting pins and the second removal grooves lead said cutting pins on each of the opposite sides of said cutting blade (4).

2. A rock drill, as set forth in claim 1, wherein the equal number of said cutting pins (5) are located on each of the opposite sides of said cutting blade (4).

3. A rock drill, as set forth in claim 1, wherein the acute angle (a) is in the range of 40° to 70°.

4. A rock drill, as set forth in claim 1, wherein said cutting pins (5) are inclined outwardly in the drilling direction relative to the shank axis.

5. A rock drill, as set forth in claim 1, wherein said end face is conically shaped with the apex of the conically shaped end face located on the axis of said shank, said cutting blade (4) has an apex located on the axis of said shank with a pair of cutting edges (7, 8) inclined outwardly from the apex with the inclination being opposite to the drilling direction, said cutting pins having leading ends facing in the drilling direction and projecting outwardly from said end face of said drill head, said cutting edges (7, 8) forming a conically shaped plane as said rock drill rotates about the axis of said shank, and the leading ends of said cutting pins (5) located between the rotational plane of said cutting edges and said end face.

6. A rock drill, as set forth in claim 5, wherein the leading ends of said cutting pins (5) are spaced in the range of 0.3 mm to 1.5 mm from the rotational plane of said cutting edges (7, 8).

* * * * *